US005209676A

United States Patent [19]

Endo et al.

[11] Patent Number: 5,209,676

[45] Date of Patent: May 11, 1993

[54] CONNECTOR WITH TERMINAL RETAINER

[75] Inventors: Takayoshi Endo; Sakai Yagi; Masanori Tsuji; Motohisa Kashiyama, all of Shizuoka, Japan

[73] Assignee: Yazaki Corporation, Tokyo, Japan

[21] Appl. No.: 856,739

[22] Filed: Mar. 24, 1992

[30] Foreign Application Priority Data

Mar. 26, 1991 [JP] Japan ..... 3-018476[U]

[51] Int. Cl.[5] ..... H01R 13/436; H01R 13/40

[52] U.S. Cl. ..... 439/595; 439/598; 439/752

[58] Field of Search ..... 439/595, 597–600, 439/752

[56] References Cited

U.S. PATENT DOCUMENTS 5,037,336 8/1991 Betsui ..... 439/752
5,071,373 12/1991 Nagasaka et al. ..... 439/595
5,108,319 4/1992 Tsuji et al. ..... 439/595
5,123,866 6/1992 Endo et al. ..... 439/595
5,139,447 8/1992 Yoneda et al. ..... 439/595

*Primary Examiner*—Paula A. Bradley
*Attorney, Agent, or Firm*—Sughrue, Mion, Zinn, Macpeak & Seas

[57] ABSTRACT

A connector with a terminal retainer in which when a metal terminal is to be detached by moving a flexible deformable plate of a terminal retainer, excessive deflection of the flexible deformable plate is prevented. A terminal retainer is connected to a connector housing in a two-stage manner, that is, first in a provisionally-connected condition and then in a completely-connected condition. In the provisionally-connected condition, a flexible deformable plate of the terminal retainer rests on push-up projections to enable the insertion of a metal terminal. In this condition, when the flexible deformable plate is to be deflected outwardly, the flexible deformable plate abuts against an excessive deflection-preventing portion, and is prevented from being damaged.

8 Claims, 5 Drawing Sheets

CONNECTOR WITH TERMINAL RETAINER

BACKGROUND OF THE INVENTION

This invention relates to a connector used for connecting a wire harness of an automobile, and more particularly to a connector having a terminal retainer at a rear portion thereof.

In FIG. 9, a connector housing a has terminal receiving chambers b each of which has a guide notch c in each of upper and lower walls thereof, the guide notch extending from a rear end of the terminal receiving chamber to an intermediate portion thereof. Retaining projections d are formed on the side walls of the connector housing, respectively. A terminal retainer e is adapted to be attached to the connector housing a, and terminal retaining projections k for projecting into the terminal receiving chambers b through the guide notches c are formed on inner surfaces of flexible plate portions f. The terminal retainer has flexible retaining pieces h engaged with the projections d, respectively.

FIG. 10 shows the condition of use, and the terminal retaining projection k is engaged with a metal terminal i inserted in the terminal receiving chamber b to thereby prevent rearward withdrawal of the metal terminal.

In the above construction, when it is required to withdraw the metal terminal i, the flexible plate portion f is displaced outwardly by the use of a jig or the like to bring the terminal retaining projection k out of the path of movement of the metal terminal i, and in this condition the withdrawal is carried out.

In the above conventional art, when the metal terminal i is to be withdrawn, the flexible plate portion f is liable to be excessively displaced by the jig or the like, and therefore it is quite possible that the flexible plate portion may be damaged.

SUMMARY OF THE INVENTION

With the above problem in view, the present invention is intended to prevent an excessive displacement of such a flexible plate portion.

To achieve the above object, according to the present invention, there is provided a connector including: a plurality of metal terminals; a connector housing for receiving the metal terminals therein; and a terminal holder movably engaged with the connector housing in two steps, provisionally and completely, wherein the terminal holder includes a plurality of flexible deformable plates each of which has a terminal retaining member, each of the flexible deformable plate allows an insertion and withdrawal of the metal terminal in the provisionally-connected condition, and the terminal retaining member urges and fixes the metal terminal in the completely-connected condition. According to the present invention further includes a preventing member for preventing an excessive displacement of the flexible deformable plate.

In the provisionally-retained condition, when the flexible deformable plate is raised outwardly by a jig or the like, the flexible deformable plate abuts against the excessive displacement-preventing portion.

DETAILED DESCRIPTION OF THE PREFERRED EMBODIMENTS

Figure 1:
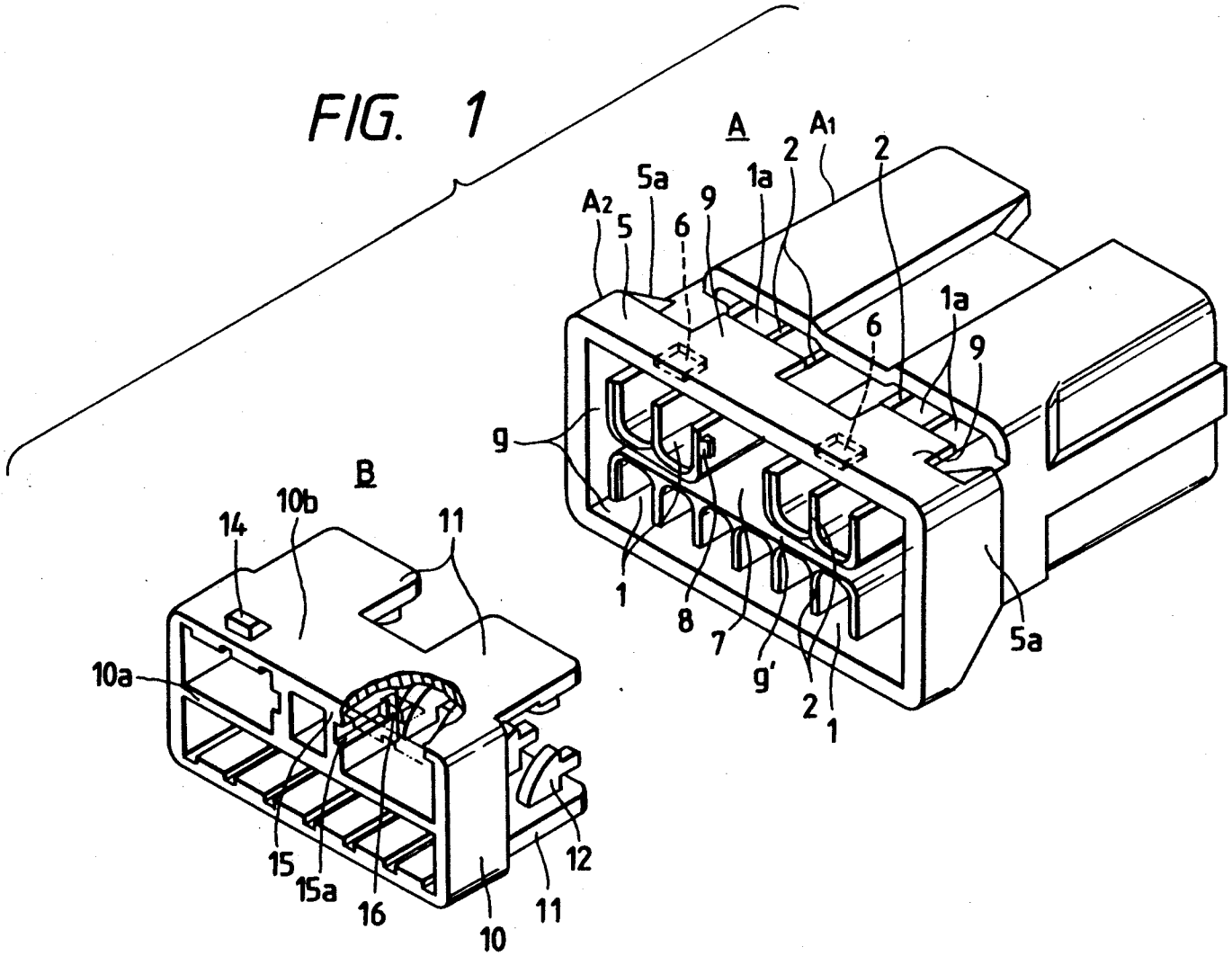
FIG. 1 is a perspective view of one embodiment of the invention.

In FIGS. 1 to 4, each of a connector housing A and a terminal retainer B is integrally formed of a synthetic resin. The connector housing A comprises a hood portion $A_1$ at a front half portion, and a terminal receiving portion $A_2$ at a rear half portion. In the terminal receiving portion $A_2$, six terminal receiving chambers 1 are juxtaposed at a lower-stage portion, and four terminal receiving chambers 1 are juxtaposed at an upper-stage portion. Each terminal receiving chamber 1 is open upwardly or downwardly (in the drawings) as at la between wall plates 2 and 2 provided respectively at the opposite sides of the terminal receiving chamber. Push-up projections 3 are formed in a row on the end faces of the wall plates 2, and each projection 3 has a taper surface disposed in the forward-rearward direction. Each terminal receiving chamber 1 has a flexible retaining piece 4 for primary retaining of a metal terminal C (see FIG. 2).

An enclosure frame 5 is mounted around the outer periphery of the rear end portion of the connector housing A, with a continuous gap g formed therebetween, the enclosure frame being connected to the connector housing via connecting portions 5*a* provided respectively at the opposite sides of the connector housing. Completely-retaining recesses 6 are formed in the inner surface of the enclosure frame 5.

An intermediate groove portion 7 is provided in the upper-stage portion of the terminal receiving portion $A_2$, and provisionally-retaining projections 8, directed toward the intermediate groove portion 7, are formed respectively at the rear ends of the opposed wall plates 2 and 2 forming the intermediate groove portion 7. Excessive displacement-preventing portions 9 extending forwardly are formed on the upper and lower portions of the enclosure frame 5.

A plurality of flexible deformable plates 11 extending forwardly are formed integrally on upper and lower portions of a main frame portion 10 of the terminal retainer B. Terminal retaining projections 12 (adapted to project into the terminal receiving chambers 1 through the openings 1*a*) for secondary retaining purposes are formed on the free ends of the flexible deformable plates 11, and relief grooves 13 are provided rearwardly of the terminal retaining projections 12.

Completely-retaining projections 14 for engaging respectively in the completely-retaining recesses 6 are formed on the outer surfaces of the upper and lower walls of the main frame portion 10 at the rear end portion thereof. An engaging frame 15 is formed between an internal partition plate 10*a* and an upper plate 10*b* of the main frame portion 10, and a receiving groove 15*a* (which extends in the forward-backward direction) and a provisionally-retaining step 16 for coacting with each provisionally-retaining projection 8 are provided at that surface of the engaging frame 15 adapted to face the provisionally-retaining projection 8.

Figure 2:
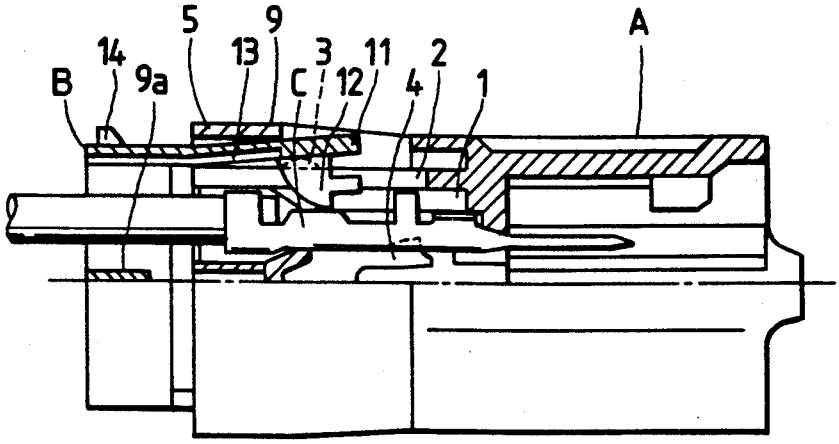
FIG. 2 is a cross-sectional view of the above embodiment in a provisionally-connected condition.

FIG. 2 shows a provisionally-connected condition in which the provisionally-retaining steps 16 formed on the engaging frame 15 of the terminal retainer B are engaged respectively with the provisionally-retaining projections 8 of the connector housing A, thereby preventing the disengagement of the terminal retainer B. In this case, the main frame portion 10 and the internal partition plate 10*a* are inserted respectively in the gaps g and g' in the connector housing A, and the flexible deformable plates 11 rest on the push-up projections 3, so that each terminal retaining projection 12 is disposed out of the path of insertion of the metal terminal C in the terminal receiving chamber 1. Therefore, each metal terminal C is smoothly inserted, and is retained by the flexible retaining piece 4.

In the condition of FIG. 2, even if it is intended to further displace the flexible deformable plates 11 outwardly, the flexible deformable plates 11 abut respectively against the excessive displacement-preventing portions 9, and is prevented from damage.

Figure 3:
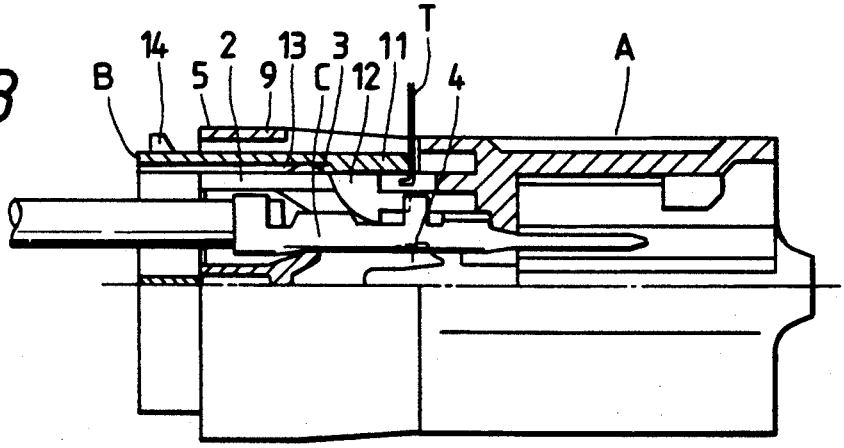
FIG. 3 is a cross-sectional view of the above embodiment in the process of shifting to a completely-connected condition.
Figure 4:
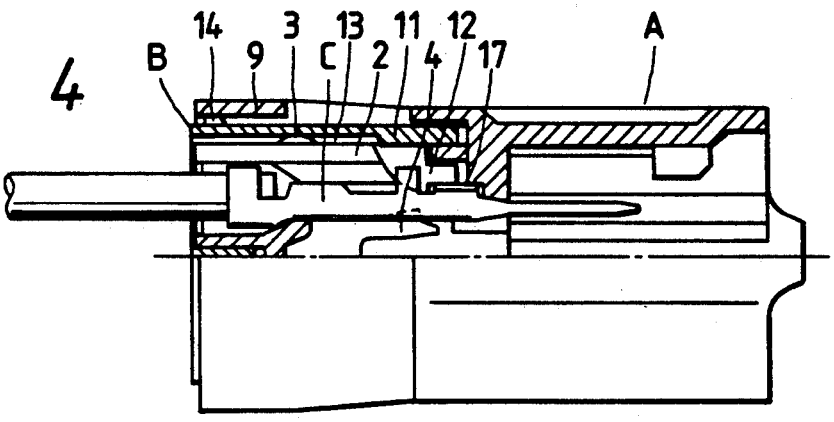
FIG. 4 is a cross-sectional view of the above embodiment in the completely-connected condition.
Figure 5:
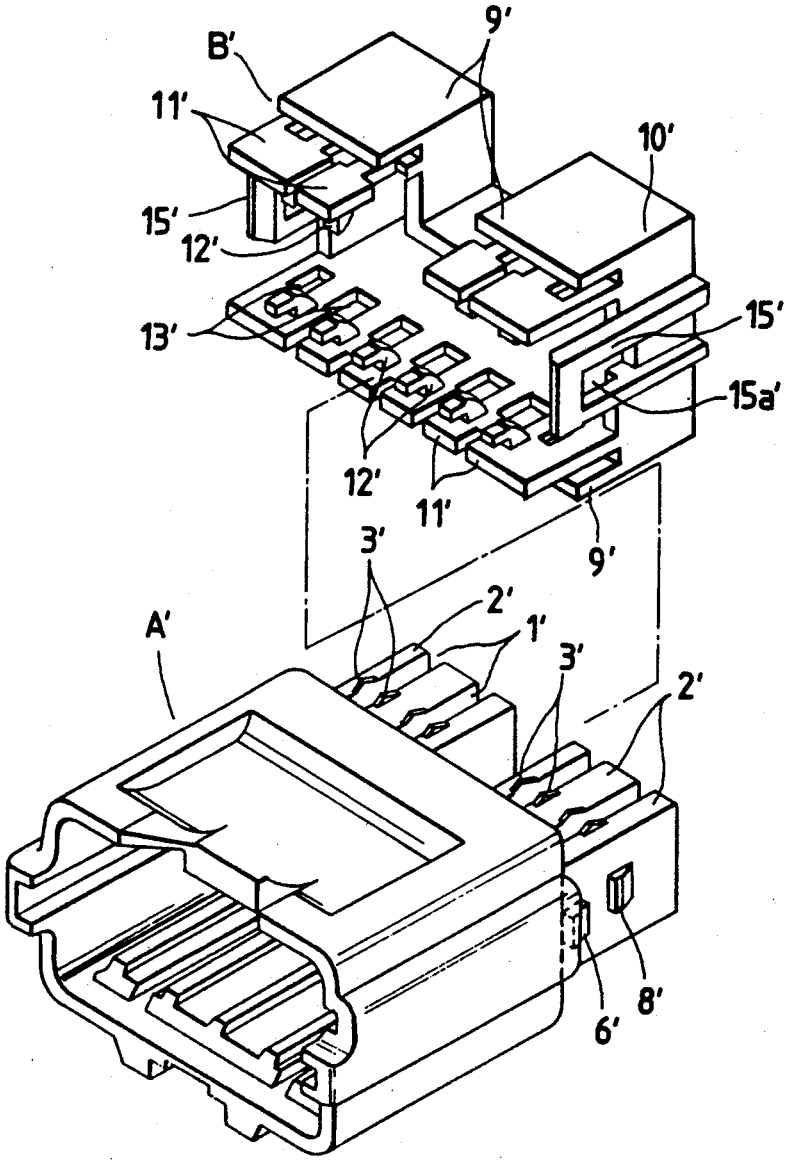
FIG. 5 is an exploded perspective view of a modified construction.

When the terminal retainer B is further pushed slightly from the position shown in FIG. 2, the push-up projections 3 are received in the relief grooves 13, so that the flexible deformable plates 11 restore, and the terminal retaining projections 12 are received deep in the terminal receiving chambers 1 (FIG. 3). When the terminal retainer B is further pushed, the completely-retaining projections 14 are received respectively in the completely-retaining recesses 6, thereby achieving the completely-connected condition. In this Case, the terminal retaining projection 12 is positioned at the rear end of an intermediate portion 17 of the metal terminal C, thereby retaining the metal terminal C in a double manner (FIG. 4).

In FIG. 3, even when the flexible deformable plate 11 is raised by a jig T, it is abutted against the excessive displacement-preventing portion 9, and is prevented from damage.

Referring to a construction shown in FIGS. 5 to 8, in a connector housing A', the above-mentioned enclosure frame 5 is omitted, and a provisionally-retaining projection 8' and a completely-retaining projection 6' are formed on each of right and left outermost wall plates 2'. In a terminal retainer B', flexible retaining arms 15' each having a retaining hole 15*a'* are provided respectively on right and left sides of a main frame portion 10', and extend forwardly, and excessive displacement-preventing portions 9' are provided outwardly of flexible deformable plates 11', and are spaced an appropriate distance therefrom.

Figure 6:
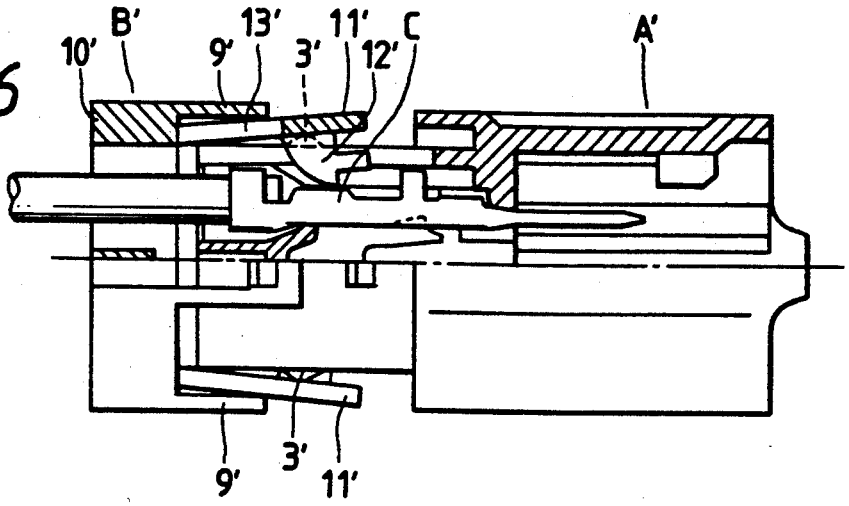
FIG. 6 is a cross-sectional view of the modified construction in a provisionally-connected condition.

FIG. 6 shows a provisionally-connected condition in which each flexible retaining arm 15' of the terminal retainer B' is engaged with the provisionally-retaining projection 8' of the connector housing A', and each flexible deformable plates 11' rests on push-up projections 3', so that each terminal retaining projection 12' is disposed out of a path of insertion of a metal terminal C in a terminal receiving chamber 1'.

Figure 7:
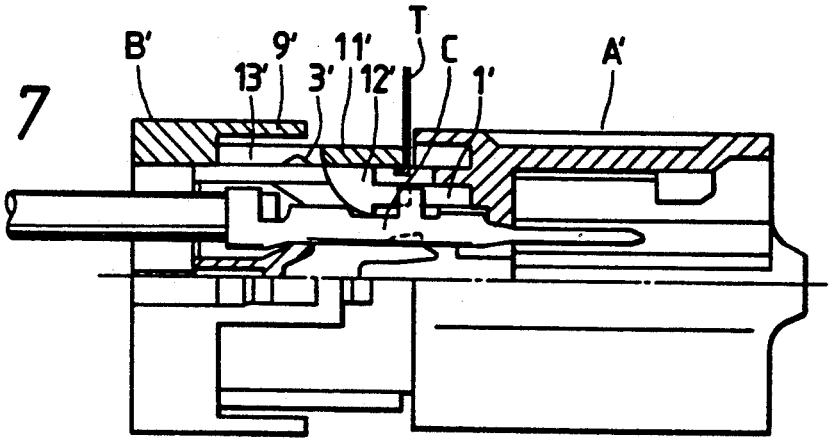
FIG. 7 is a cross-sectional view of the modified construction in the process of shifting to a completely-connected condition.
Figure 8:
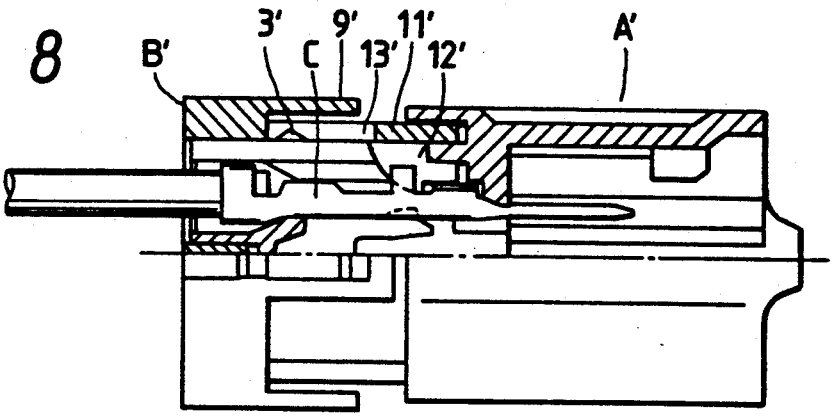
FIG. 8 is a cross-sectional view of the modified construction in the completely-connected condition.
Figure 9:
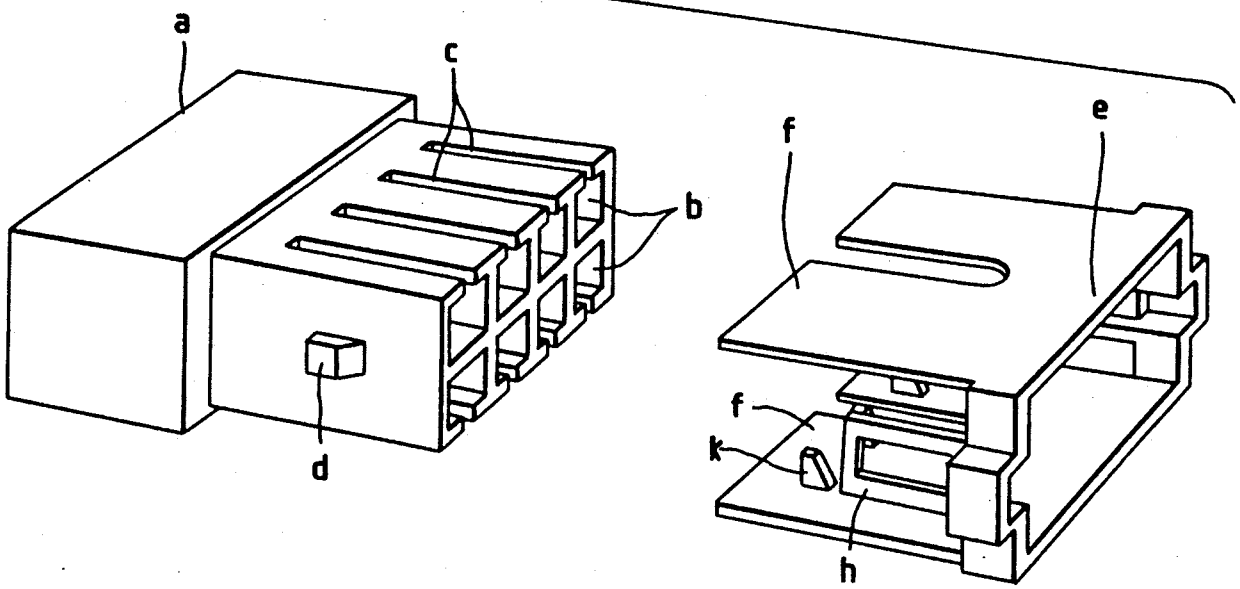
FIG. 9 PRIOR ART
FIG. 9 is an exploded perspective view of a conventional construction.
Figure 10:
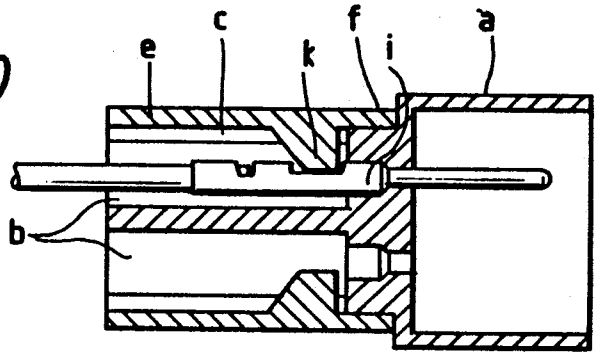
FIG. 10 PRIOR ART
FIG. 10 is a cross-sectional view of the conventional construction in a connected condition.

When the terminal retainer B' is slightly pushed from the position shown in FIG. 6, the push-up projections 3' are received in the relief grooves 13', so that the flexible deformable plates 11' restore, and the terminal retaining projections 12' are disposed deep in the terminal receiving chambers 1', respectively (FIG. 7). When the terminal retainer B' is further pushed, the flexible retaining arms 15' are engaged respectively with the completely-retaining projections 6', thereby achieving the completely-connected condition, and the terminal retaining projections 12' are engaged respectively with the metal terminals C, thereby retaining the metal terminals C in a double manner (FIG. 8). In FIGS. 6 and 7, when the flexible deformable plate 11' is raised by a jig T or the like, it is abutted against the excessive displacement-preventing portion 9', and is prevented from damage.

As described above, in the present invention, the connector comprises the connector housing receiving the metal terminals therein, and the terminal retainer connected to the connector housing in a two-stage manner, that is, first in the provisionally-connected condition and then in the completely-connected condition. In the provisionally-connected condition, the flexible deformable plate of the terminal retainer allows the insertion and withdrawal of the metal terminal, and in the completely-connected condition, the flexible deformable plate engages the metal terminal. In this construction, the excessive displacement-preventing portion for the flexible deformable plate is provided on the terminal retainer or the connector housing. Therefore, when the metal terminal is to be detached by moving the flexible deformable plate engaged with the metal terminal, damage to the flexible deformable plate due to its excessive displacement can be prevented.

What is claimed is:

1. A connector comprising:

a plurality of metal terminals;

a connector housing for receiving said metal terminals therein;

a terminal holder movably engaged with said connector housing in two steps, provisionally and completely, said terminal holder including a plurality of flexible deformable plates each of which has a terminal retaining member, each of said flexible deformable plates being deflected to allow an insertion and withdrawal of a corresponding metal terminal in the provisionally-connected condition, and said terminal retaining member urging and fixing said corresponding metal terminal in the completely-connected condition, said deflection of each of said deformable plates for permitting withdrawal of said corresponding metal terminal being caused by an external jig inserted into said terminal holder; and means for preventing an excessive deflection of each of said flexible deformable plates by said jig.

2. A connector according to claim 1, wherein said terminal retainer and said connector housing have an insertion path along which said metal terminal is inserted and said terminal holder has a plurality of relief notches, and wherein each of said terminal retaining members is disposed out of said insertion path in the provisionally connected condition, and each of said push-up projections is engaged with said relief notch so that each of said flexible deformable plates is restored to a non-deflected condition to bring said terminal retaining member deep into said connector housing.

3. A connector according to claim 1, wherein said preventing means includes a plurality of excessive deflection-preventing plates; and each of said flexible deformable plates abuts against said excessive deflection-preventing plate when said flexible deformable plates is excessively deflected.

4. A connector according to claim 3, wherein said preventing means is integral to said connector housing.

5. A connector according to claim 3, wherein said preventing means is integral to said terminal retainer.

6. A connector according to claim 5, wherein each of said excessive deflection-preventing plates is disposed outside of said flexible deformable plate.

7. A connector, comprising:

a plurality of metal terminals;

a connector housing for receiving said metal terminals therein;

a terminal holder movably engaged with said connector housing in two steps, provisionally and completely, said terminal holder including a plurality of flexible deformable plates each of which has a terminal retaining member, each of said flexible deformable plates allowing an insertion and withdrawal of a corresponding metal terminal in the provisionally-connected condition, and said terminal retaining member urging and fixing said corresponding metal terminal in the completely-connected condition; and means for preventing an excessive deflection of each of said flexible deformable plates, wherein said connector housing includes an enclosure frame disposed around an outer periphery of a rear end thereof, said excessive deflection-preventing plates being integral to said enclosure frame.

8. A connector, comprising:

a plurality of metal terminals;

a connector housing for receiving said metal terminals therein;

a terminal holder movably engaged with said connector housing in two steps, provisionally and completely, said terminal holder including a plurality of flexible deformable plates each of which has a terminal retaining member, each of said flexible deformable plates allowing an insertion and withdrawal of a corresponding metal terminal in the provisionally-connected condition, and said terminal retaining member urging and fixing said corresponding metal terminal in the completely-connected condition; and means for preventing an excessive deflection of each of said flexible deformable plates, wherein said connector housing includes a plurality of push-up projections; and said flexible deformable plates respectively rest on said push-up projections for allowing insertion and withdrawal of said metal terminals in the provisionally-connected condition.

* * * * *